US006390885B1

(12) United States Patent
Brooks

(10) Patent No.: US 6,390,885 B1
(45) Date of Patent: May 21, 2002

(54) SURGICAL RECOVERY BRASSIERE

(76) Inventor: Debra A. Brooks, 6073 Cherokee Valley Ter., Lithonia, GA (US) 30058

( * ) Notice: Subject to any disclaimer, the term of this patent is extended or adjusted under 35 U.S.C. 154(b) by 0 days.

(21) Appl. No.: 09/829,637

(22) Filed: Apr. 10, 2001

Related U.S. Application Data

(60) Provisional application No. 60/196,145, filed on Apr. 11, 2000.

(51) Int. Cl.[7] ..... A41C 3/00

(52) U.S. Cl. ..... 450/1; 450/3; 450/54

(58) Field of Search ..... 450/1, 3–8, 19–21, 450/36, 38, 39, 54, 55, 58, 60–63; 602/1, 19, 60, 61, 75–77, 4; 2/69, 102, 113–115, 104–106

(56) References Cited

U.S. PATENT DOCUMENTS

| | | | | | |
|---|---|---|---|---|---|
| D245,547 | S | | 8/1977 | Surace | |
| 4,087,864 | A | * | 5/1978 | LaBove et al. | 2/102 |
| 4,187,855 | A | | 2/1980 | Paulus et al. | |
| 4,369,792 | A | | 1/1983 | Miller | |
| 4,578,062 | A | * | 3/1986 | Schneider | 450/1 |
| 4,582,508 | A | * | 4/1986 | Pavelka | 450/1 |
| 4,666,432 | A | * | 5/1987 | McNelsh et al. | 450/1 |
| 4,799,923 | A | * | 1/1989 | Campbell | 450/1 |
| 4,804,351 | A | | 2/1989 | Raml et al. | |
| 5,048,122 | A | * | 9/1991 | Prieur | 2/69 |
| 5,180,326 | A | | 1/1993 | Williams | |
| 5,336,195 | A | * | 8/1994 | Daneshvar | 450/1 |
| 5,429,593 | A | | 7/1995 | Matory | |
| 5,806,096 | A | * | 9/1998 | Pennington | 2/80 |
| 6,048,252 | A | * | 4/2000 | Sebring | 450/1 |
| 6,055,668 | A | * | 5/2000 | Gros et al. | 2/69 |

* cited by examiner

*Primary Examiner*—Gloria M. Hale
(74) *Attorney, Agent, or Firm*—Kim S. Manson, Attorney

(57) ABSTRACT

The present invention, in the preferred embodiment, is a surgery recovery brassiere which resolves many of the problems faced by women who have undergone breast surgery and particularly, mastectomy. The present invention comprises front panels, prosthesis panels, rear panels, torso band, straps, drain tube apertures and fluid collection storage pouch.

More specifically, two front panels each comprise a cup portion and a conforming portion. The prosthesis panels are attached to the rear facing of the cup portion of the front panel to form enclosed pockets to hold one or two prosthesis. Each of the two rear panels are joined at one end to the front panels and extend to meet the opposing rear panel at a back closure. The free end of each of the front panels meet to form a front closure. Straps extend from the top of the front panel to the top of the adjacent rear panel. The torso band extends around the lower edge of the surgery recovery brassiere to form an almost continuous strip of material along the lower edge of the front and rear panels.

The surgery recovery brassiere further accommodates post-operative surgical drainage systems composed of one or more drain tubes and associated fluid collection bulbs. The position of drainage tube apertures, generally located proximate to the joint between the front and rear panels, allow drainage tubes to protrude from the chest wall, through the apertures and into the collection storage pouch. Tab closures allow the wearer to secure the drainage tubes within the aperture to further reduce movement of the tubes and disturbance of the drainage system. The storage pouch provides pockets with elastic top entry so that collection bulbs are within easy, convenient reach for emptying lymphatic fluids and other waste materials. The upper edge of the storage pouch releasably attaches to the torso band with a hook-and-loop fastener system.

20 Claims, 7 Drawing Sheets

SURGICAL RECOVERY BRASSIERE

CROSS-REFERENCE TO RELATED APPLICATIONS

This application is entitled to the benefit of Provisional Patent Application Serial No. 60/196,145 filed Apr. 11, 2000.

TECHNICAL FIELD

The present invention relates generally to surgical appliances and supplies and, more specifically, to a garment worn by women who have undergone breast surgeries.

BACKGROUND ART

Each year, thousands of women undergo breast surgery. Of all the surgeries that a woman may experience, breast surgery, and particularly mastectomy or removal of a breast or breasts, is the most traumatic. A mastectomy is the most common surgical procedure performed when a malignant tumor is found. The type of surgery depends upon the staging of the tumor and the client's preferences. Although many women look for more conservative treatment and less destructive surgery than removal of the breast, mastectomy continues to be the preferred course of treatment to increase the likelihood of destroying the breast cancer. Mastectomy procedures include modified radical mastectomy (removal of the underlying muscle as well as the breast), simple mastectomy (removal of one breast), bilateral mastectomy (removal of both breasts) and lumpectomy (removal of a portion of the breast).

When the cancer involves the muscle or interpectoral node, substantially more muscle and tissue must be removed. Removal of auxiliary nodes and lymphatic channels predisposes the client to infection and lymphatic obstruction. Edema, an abnormal excess accumulation of serious fluid in connective tissue, is a frequent occurrence in breast surgeries unless positive steps are taken to prevent it. The body develops a collateral lymphatic drainage system usually within 3 to 4 weeks postoperatively. In the interim, lymphatic fluid production must be drained to prevent infection and promote healing.

Post operative drainage tubes are placed in the body to aid in lymphatic fluid drainage. Drainage tube systems are used not only for mastectomies but also for breast reconstructive surgery as well as for less radical surgeries for breast enlargement or breast reduction. The drainage tube system conventionally consists of one to two flexible tubes which exit the chest wall on one or both sides of the body in the area of the incision wound. The drainage tubes extend outside the body and a collection bulb or cup is installed on the end of the drainage tube to collect lymphatic fluids and tissue debris. The drainage tubes and collection bulbs are conventionally gathered together and pinned to the front of the patient's gown with a safety pin. The collection bulb must be emptied of lymphatic discharge on a regular basis, approximately every hour to promote free flow of discharge. The entire drainage system must be supported to prevent pain and inflammation resulting from the disruption and separation of the tubes from the chest wall.

Although the physical changes resulting from mastectomy and other breast surgeries require weeks or even months of recovery time, the psychological changes are even more difficult and require a much longer recovery time to overcome. In the time period immediately following surgery, a woman must overcome not only pain, limited mobility in the arms, and an extensive drainage system, but also a feeling of flatness and imbalance resulting from the loss of the weight of the breast. These physical changes often delay the beginning of psychological healing that is essential to recovery of total well-being in the patient. Doctors recommend that a mastectomy patient begin to wear a prosthesis as soon as possible to being this healing process. The sooner a woman can don a prosthesis and provide the body with a feeling of balance and wholeness, the sooner she will come to terms with the traumatic change in her body and the greater the chances of regaining mental well being.

The change in the physical appearance of the patient requires visual and uncomplicated relief as soon as possible. At times a patient will require a more customized fitting to achieve her pre-surgery appearance. The present invention allows the patient to achieve a womanly appearance in the interim until she is sufficiently recovered to face the search for a fitted bra, prosthesis and fitter to meet her needs.

BACKGROUND—DESCRIPTION OF PRIOR ART

It will be recognized that although there are a number of medically supported articles that are conventionally known and medically employed for post-operative recovery of surgeries in and around the breast area, none of the articles offer solutions for prosthetic applications which accommodate the fluid drainage systems used routinely in surgical practice for removal of fluids after breast surgery. To the contrary, conventionally known articles either address incision wounds to the chest wall in general or provide prosthetic support. Such articles do not provide a breast surgery patient with the ability to don a prosthetic brassiere which accommodates drainage systems in the days following her surgery.

Articles which generally accommodate chest wall surgeries include compression dressings and cardio-thoracic brassieres. One such article may be found by reference to U.S. Pat. No. 5,429,593 to Matory, a post surgical drainage accommodating, compression dressing and garment to be worn by a man or a woman after chest wall surgery to cover and compress at least one surgical incision site on the upper torso. The patent to Matory does not support prosthetic applications. Further, compression dressings can exacerbate breast surgery recovery because no allowance is made to accommodate shifting caused by differential heights between the remaining breast and the area where the breast was removed. Another example of an article designed to accommodate chest wall surgery maybe found by reference to U.S. Pat. No. 4,804,351 to Raml et al., a surgical brassiere for use by female patients following cardio-thoracic surgery which provides a ventilated panel over the mid sternal incisional line. The referenced design to Raml et al. does not provide for prosthesis use.

On the other hand, conventionally known mastectomy brassieres are directed primarily toward prosthesis use but may only be comfortably used several weeks after surgery when post-operative fluid drains are removed. Merely representative of such prior art articles are the following: a garment for use after breast surgery with enlarged arm openings and an elongated bodice portion to fit over the wearer's torso and assist in holding the garment in place as disclosed in U.S. Pat. No. 4,187,855 to Paulus et al.; a brassiere for supporting prosthesis that is cut low under the woman's arms to avoid sensitive surgical incisions that provides pockets to receive prosthesis as shown in U.S. Pat. No. 4,369,792 to Miller; and a reversible mastectomy brassiere which positions a prosthesis on the left breast of a mastectomy patient or alternatively on the right breast of the patient as described by U.S. Pat. No. 5,180,326 to Williams. The waist bands, side panels and elongated bodices of such articles make no accommodation for post-operative drains exiting the chest wall and often result in pain if used too soon after surgery.

Such prior art designs do not firmly hold the prosthesis in place. An example of one such design is the '792 patent to Miler. When a woman bends over, the prosthesis can readily fall out due to open top construction of the prosthetic support cup.

Further, the use of such articles can result in the disruption and separation of the drainage tubing from the chest wall. Because conventionally known prosthetic brassieres cannot be properly fitted around the drainage tubes, the brassiere often shifts out of place. At a time when the patient's psychological needs demand that the brassiere to fit as naturally as possible, drain tubes prevent proper use of the prosthesis. Drainage tubes typically remain in place for at least one month ???? after surgery. However, psychological healing should begin well before this time.

An additional burden during the initial weeks of recovery is the placement and storage of collection bulbs. The bulbs must be regularly emptied of fluid. For breast reconstruction surgery in particular, the patient must handle up to four collection bulbs. A convenient, unobtrusive method of accommodating fluid collection bulbs for a woman wearing a prosthetic brassiere is not available in the prior art.

These prior art designs illustrate the range and variety of garments and articles that do not address the need for a mastectomy patient to wear a prosthesis brassiere that accommodates lymphatic fluid drainage systems immediately after surgery. In addition, the cited art does not include a reliable, drain accommodating means of providing a readily available, prosthesis-securing brassiere that a patient can wear within hours of surgery.

Accordingly, it will be recognized that there is a need for a prosthetic brassiere which may be worn by a female patient immediately after breast surgery generally or after surgery to remove a breast specifically, which will accommodate multiple surgical drains in a manner which will avoid disruption of the drains from the chest wall. In addition, if such a garment were also able to provide a storage facility for collection bulbs and further ensure secure placement of the prosthesis so as to enable the patient to assume her pre-surgery appearance quickly, such a garment would be recognized by the medical community as a major advance in this art. It is, therefore, to the provision of such an improvement that the present invention is directed.

BRIEF SUMMARY OF THE INVENTION

Briefly described, in a preferred embodiment, the present invention overcomes the above-mentioned disadvantages by providing a surgery recovery brassiere which (1) can be worn immediately after surgery, (2) accommodates a plurality of drainage tubes by minimizing the amount of tubing outside the garment, (3) stores fluid collection bulbs in a convenient location under the breasts, (4) provides front and back closures to meet the varying needs of the patient, and (5) securely holds readily available prosthesis in place. Generally, the present invention, in the preferred embodiment, comprises front panels, prosthesis panels, rear panels, torso band, straps, drain tube apertures and fluid collection storage pouch.

More specifically, two front panels each comprise a cup portion and a conforming portion. The prosthesis panels are attached to the rear facing of the cup portion of the front panel to form enclosed pockets to hold one or two prosthesis. Each of the two rear panels are joined at one end to the front panels and extend to meet the opposing rear panel at a back closure. The free end of each of the front panels meet to form a front closure. Straps extend from the top of the front panel to the top of the adjacent rear panel. The torso band extends around the lower edge of the surgery recovery brassiere to form an almost continuous strip of material along the lower edge of the front and rear panels.

The surgery recovery brassiere further accommodates post-operative surgical drainage systems composed of one or more drain tubes and associated fluid collection bulbs. The position of drainage tube apertures, generally located proximate to the joint between the front and rear panels, allow drainage tubes to protrude from the chest wall, through the apertures and into the fluid collection storage pouch. Tab closures allow the wearer to secure the drainage tubes within the aperture to further reduce movement of the tubes and disturbance of the drainage system. The storage pouch provides divided pockets with elastic top entry so that collection bulbs are within easy, convenient reach for emptying lymphatic fluids and other waste materials.

In accordance with the present invention, the front panels, rear panels, prosthetic panels, straps and torso band are sewn together to form a unitary or one-piece structure. The upper edge of the storage pouch releasably attaches to the torso band with VELCRO, a hook-and-loop fastener system. The storage pouch, like the torso band, forms a continuous band of material around the torso. The pouch has a front closure means, preferably with VELCRO.

OBJECTS AND ADVANTAGES

A feature and advantage of the present invention is to provide a new and improved surgery recovery brassiere which can be worn acutely after surgery to begin psychological healing and provide physical balance to the body.

Another feature and advantage of the present invention is to provide a new and improved surgery recovery brassiere which accommodates drainage tubing and minimizes binding or disruption of the surgical drainage system.

A further feature and advantage of the present invention is to provide a new and improved surgery recovery brassiere that allows fluid collection devices to be conveniently stored in as inconspicuous, least obtrusive location as possible, further minimizing the opportunity to disrupt the surgical drainage system.

Yet another feature and advantage of the present invention is to provide a new and improved surgery recovery brassiere that secures a prosthesis or multiple prosthesis in correct position in relation to the body so as to prevent shifting of the prosthesis when the wearer bends or leans over.

A still further feature and advantage of the present invention is to provide a new and improved surgery recovery brassiere that provides economical value in eliminating the need for prosthetic garments after drainage system is removed; the surgery recovery brassiere can be worn acutely after surgery as well as long term for continuing prosthetic support.

An additional feature and advantage of the present invention is to provide a new and improved surgery recovery brassiere that can be used for one prosthesis if only breast has been removed or for two prosthesis if bilateral mastectomy has been performed.

Another feature and advantage of the present invention is to provide a new and improved surgery recovery brassiere that can be used for patients undergoing breast enlargement or breast reduction, both surgeries being procedures which demand immediate support of breast tissues but also utilize surgical drains for removal of lymphatic fluids.

These and other objects, features and advantages of the invention will become more apparent to one skilled in the art from the following description and claims when read in light of the accompanying drawings.

DETAILED DESCRIPTION OF THE PREFERRED AND ALTERNATE EMBODIMENTS

In describing the preferred embodiment of the present invention as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

The present invention is designed to meet the needs of a patient recovering from breast surgery in general and from mastectomy surgical procedures in particular. When constructed in the manner described hereinafter, the present invention has many unique structural features and desirable capabilities. These include the following:

(a) Right and left cup portions may be sized prior to surgery so that a balanced, womanly look may be achieved immediately after surgery without costly and time-consuming fittings.

(b) Enclosed pockets for securedly receiving prosthesis for one or both breasts consisting of overlapping panels which allow the prosthesis to remain in the desired position and location.

(c) Dual closures in the front and back of the present invention allows easy examination by the physician to the areas surrounding the incision site. Moreover, the front and back closures allow the brassiere to be easily placed and positioned on the wearer after surgery and further allows the patient to adjust the position of the invention on her own body at will without assistance.

(d) Right and left apertures sized and positioned to receive drain tubes extending from surgically implanted drainage systems. The apertures are positioned so that the drain tubes feed directly into the fluid collection pouch described below, minimizing the inherent dangers of accidentally pulling or tugging on the drainage assembly.

(e) A pouch to hold collection bulbs frequently found in surgical drainage systems. The weight of the bulb with collected fluid is held by within the pouch. The positioning of the pouch under the breasts allows easy access to empty filled bulbs. This positioning of the pouch also aids in allowing the patient to wear loose clothing sooner than would otherwise be possible since the collection bulbs are effectively removed from sight underneath the clothing.

Figure 1:
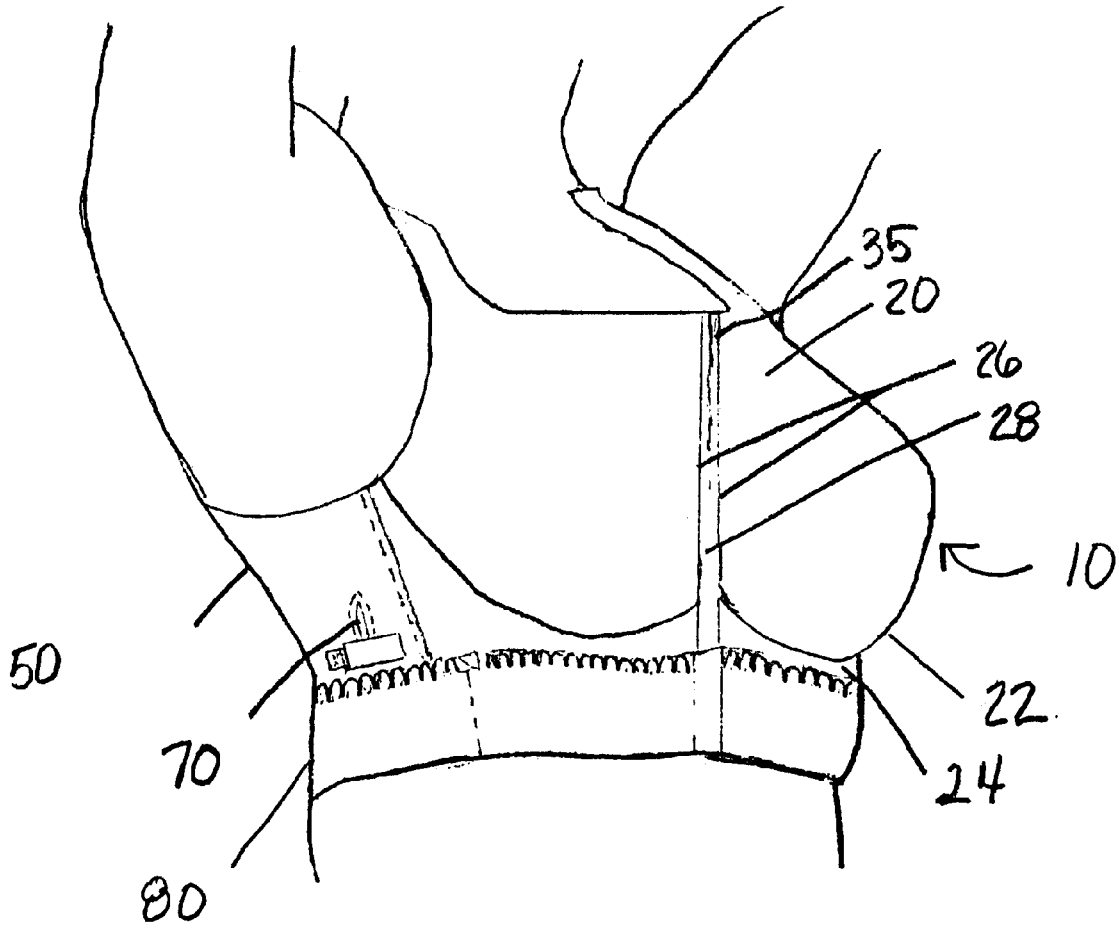
FIG. 1 is a perspective view of the present invention according to a preferred embodiment.
Figure 2:
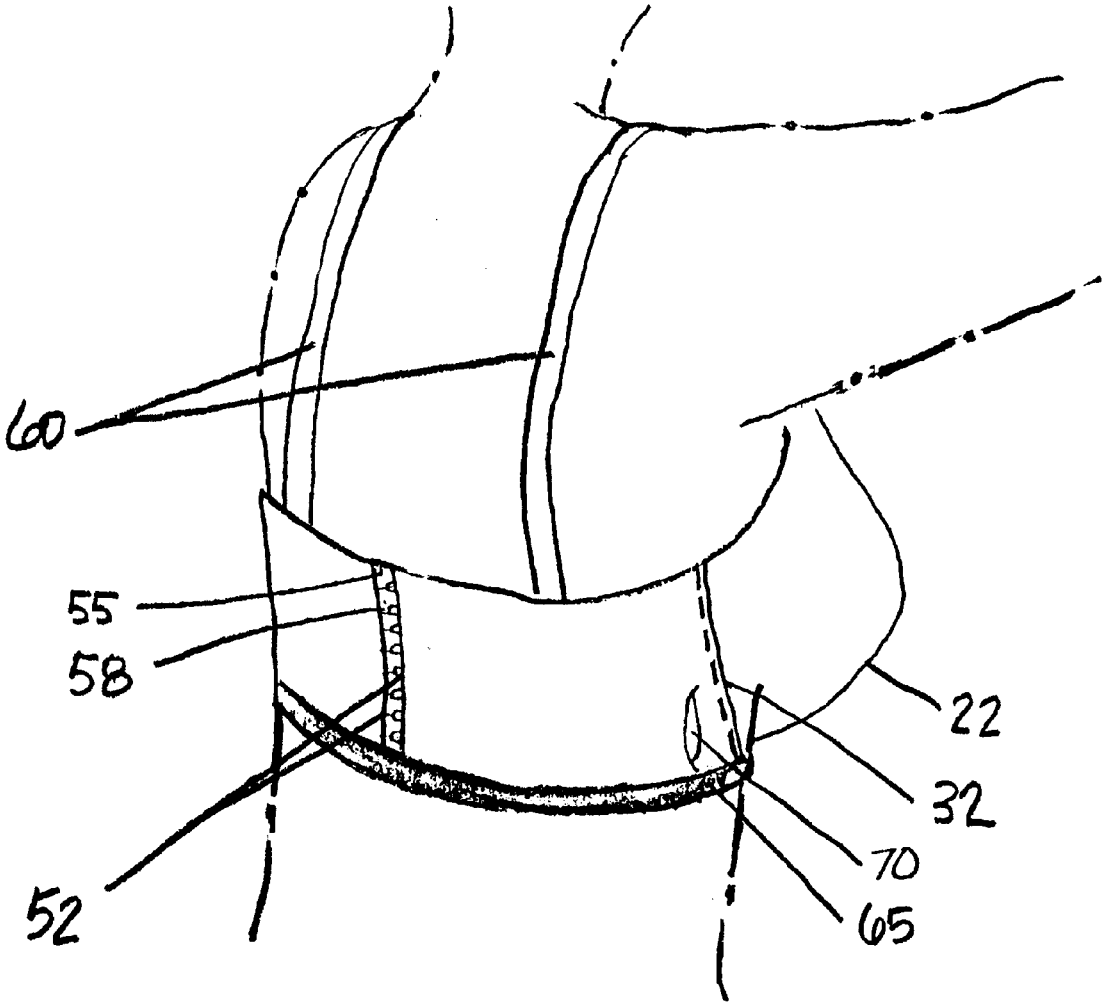
FIG. 2 is a rear perspective view of the present invention according to a preferred embodiment.

FIGS. 1 and 2 show one preferred embodiment of the surgery recovery brassiere. Intimate apparel garments such as brassieres must provide both function and comfort. To that end, a wide range of synthetic materials and natural materials may be used in the construction of the surgery recovery brassiere. Synthetic elastomers including LYCRA and SPANDEX may be used as well as other conventionally known materials in the art. Natural/synthetic blended materials may include cotton, linen, rayon or ramie. It is most desirable that the materials employed, whether blended or unblended, provide a soft, smooth feel against the skin of the wearer. Therefore, the preferred material for the surgery recovery brassiere is an all-cotton cloth. However, all conventionally known materials are deemed to be within the scope of the present invention.

Similarly, a wide choice of fasteners are available for the front and back closures, the storage pouch closure, and to adhere the storage pouch to the torso band of the surgery recovery brassiere. While VELCRO is the preferred material for the front closure, hook and eyes are preferably used for the back closure. VELCRO is also utilized to secure the storage pouch to the torso band. The closure of the storage pouch is also preferably fastened with VELCRO. However, such preferred materials do not preclude alternative use of VELCRO or other hook-and-loop fasteners, zippers, buttons and button holes, snaps, hooks and eyes, other types of hook arrangements, etc., as well as other fasteners well known in the art.

Referring again to FIGS. 1 and 2, surgery recovery brassiere 10 generally comprises front panels 20, prosthesis panels 40, rear panels 50, straps 60, torso band 65, drain tube apertures 70 and fluid collection storage pouch 80. Each of these will be described in detail.

The surgery recovery brassiere 10 is to be worn by a patient after breast surgery to provide prosthesis support, breast support and support for the surgical drain system with associated tubing and fluid collection bulbs. Front panels 20 provide breast support and each panel comprises a cup portion 22 and a conforming portion 24. The cup portion 22 holds and supports the breast or prosthesis 42. Conforming portion 24 extends beneath cup 22 and between cup 22 and edge of front panel 20. Edges designated as 26, 26, in combination, form front closure 28. Along edge 26 of front panel 20 is positioned one-half of a fastening device. The preferred fastening device for front closure 28 is a hook-and-loop fastener arrangement such as VELCRO. Strip 35 fits behind one half of the front closure 28 to isolate the fastening arrangement from the skin of the wearer. Strip 35 may be placed on right or left of front closure 28 to isolate hook-and-loop fastener arrangement from skin of wearer. However, if the fastening device is, as an alternative example, a hook and eye fastener arrangement, strip 35 is positioned behind the eyes so that when edges 26 are fastened together, neither hooks or eyes come in contact with the skin.

As shown in FIG. 2, rear panel 50 is joined to front panel 20 at seams 32. Rear panel 50 extends from seam 32 to edge 52. Edges 52, in combination, form back closure 58. The preferred fastening device for back closure 58 is a hook and eye fastener arrangement. Strip 55 is positioned behind the eyes so that when edges 52 are fastened together, neither hooks or eyes come in contact with the skin. Strip 55 would also prevent alternative fasteners such as zippers or buttons from contacting the skin.

Figure 3A:
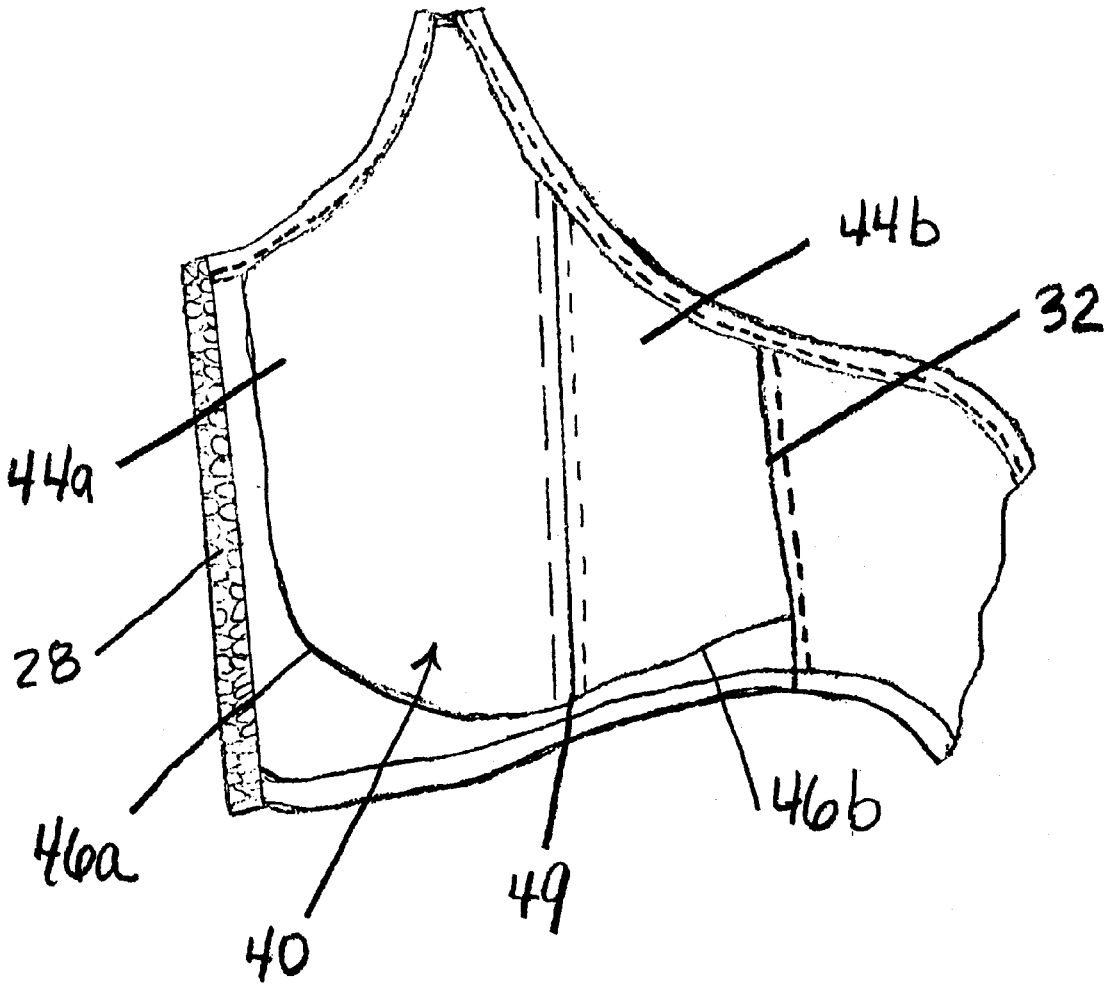
FIG. 3*a* is a sectional view of the prosthetic support panel according to a preferred embodiment.

Prosthesis panel 40 provides secure support to hold selected prosthesis 42 securely in place. Referring now to FIG. 3*a*, prosthesis panel 40 is attached to the rear facing of cup portion 22 of front panel 20 to form pockets to contain prosthesis 42. Prosthesis panel 40 comprises a pair of fabric panels 44*a* and 44*b*. Panel 44*a* is stitched along line 46*a* which proceeds from bottom edge of cup, up along edge of front closure, and across top edge of cup 22. Panel 44*b* is stitched along line 46*b* which proceeds from bottom edge of cup 22, up along seam 32 and across the top edge of cup 22. Panel 44*b* overlies panel 44*a* along line 49 so that each panel extends across line 49. Line 49 runs substantially parallel to the vertical center of cup portion 22. Prosthesis 42 is contained within a pocket formed between cup portion 22 and panels 44*a* and 44*b*.

Figure 3B:
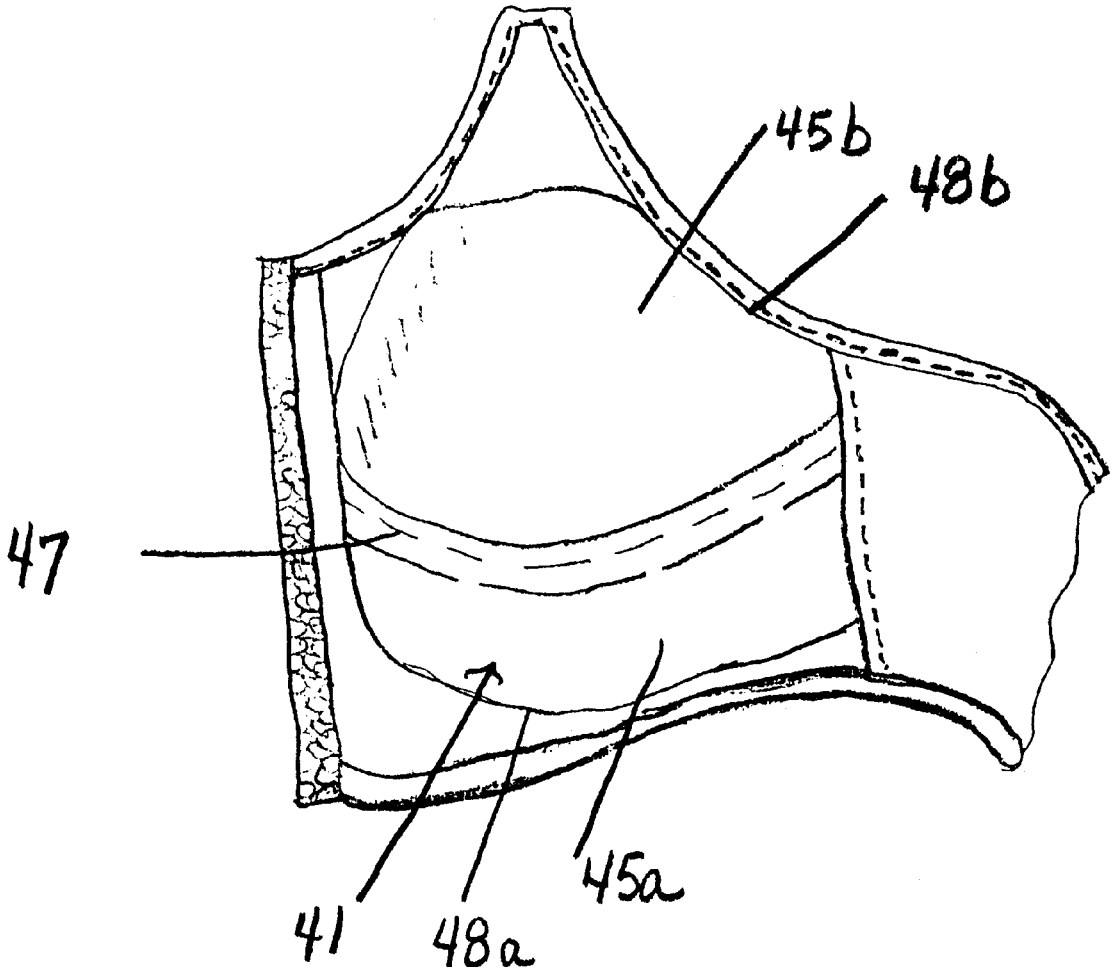
FIG. 3*b* is a sectional view of the prosthetic support panel according to an alternate embodiment.

Shown in FIG. 3*b* is an alternative embodiment of prosthesis panel labeled 41. Prosthesis panel 41 may comprise fabric panels 45*a* and 45*b* so that panels 45*a* and 45*b* are oriented to form a horizontal rather than vertical overlap as described above. Prosthesis panel 41 comprises a pair of fabric panels 45*a* and 45*b* which are generally in the shape of an elongated oval cut in half. Panel 45*a* is stitched to the bottom edge of cup portion along line 48*a* which forms about one-half of the oval periphery while panel 45*b* is stitched along the top edge of cup portion along line 48*b*. Panel 45*b* overlies panel 45*a* along line 47 so that panel 44*b* extends above line 47 and panel 44*a* extends below line 47. Line 47 runs substantially parallel to the horizontal center of cup portion 22. Prosthesis 42 is contained within a pocket formed between cup portion 22 and panels 45*a* and 45*b*.

FIGS. 1 and 2 show straps 60 which extend from the top of each front panel 20 to the top of the adjacent rear panel 50. Alternatively, straps 60 may form a cross pattern wherein straps 60 extend from the top of each front panel 20 to the top of the opposite rear panel 50. Torso band 65, shown more clearly in FIG. 2, extends around the lower edge of the surgery recovery brassiere 10 to form an almost continuous strip of material from one edge of front closure 28 to the other edge of front closure 28, along the lower edge of front panels 20 and rear panels 50. Hook-and-loop fastener is attached to the entirety of torso band 65; mating hook-and-loop fastener is attached to storage pouch 80 as described more fully below.

Figure 4:
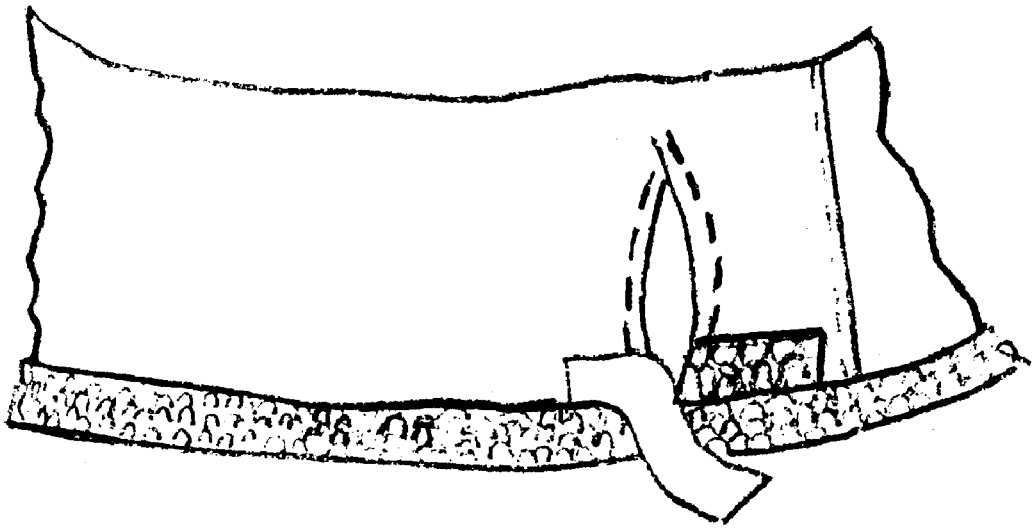
FIG. 4 is a sectional view of the drain tube aperture and tab closure according to a preferred embodiment.
Figure 5:
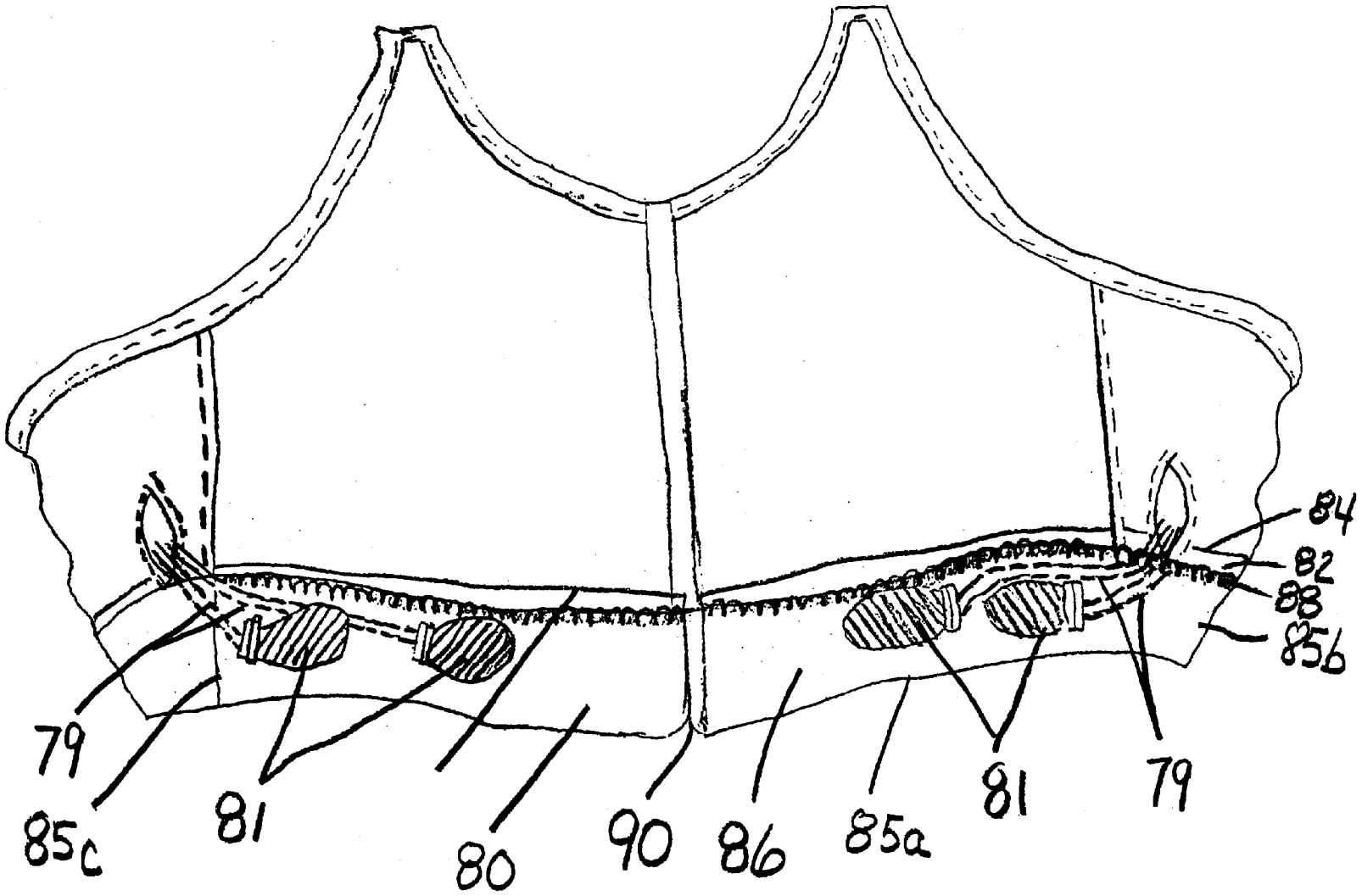
FIG. 5 is a sectional view of the storage pouch showing a plurality of collection bulbs according to a preferred embodiment.

The surgery recovery brassiere 10 further accommodates post-operative surgical drainage systems composed of one or more drain tubes 79 and associated fluid collection bulbs 81. Drain tube apertures 70, shown in FIGS. 4 and 5, are positioned to receive drainage tubes 79 exiting the chest wall. FIG. 4 is drawn to show tab closure 72 for apertures 70. FIG. 5 is drawn without tab closures 72 in order to show more clearly the relationship between drain tubes 79, apertures 70 and storage pouch 80. Apertures 70 are located proximate to seams 32 formed between front panels 20 and rear panels 50. Apertures 70 allow drainage tubes 79 to protrude from the chest wall through apertures 70 and into fluid collection storage pouch 80. Tab closures 72*a*, 72*b*, comprising mating hook-and-loop fasteners, allow the wearer to secure drainage tubes 79 to surgery recovery brassiere 10 to further reduce movement of the tubes and disturbance of the drainage system.

Figure 6:
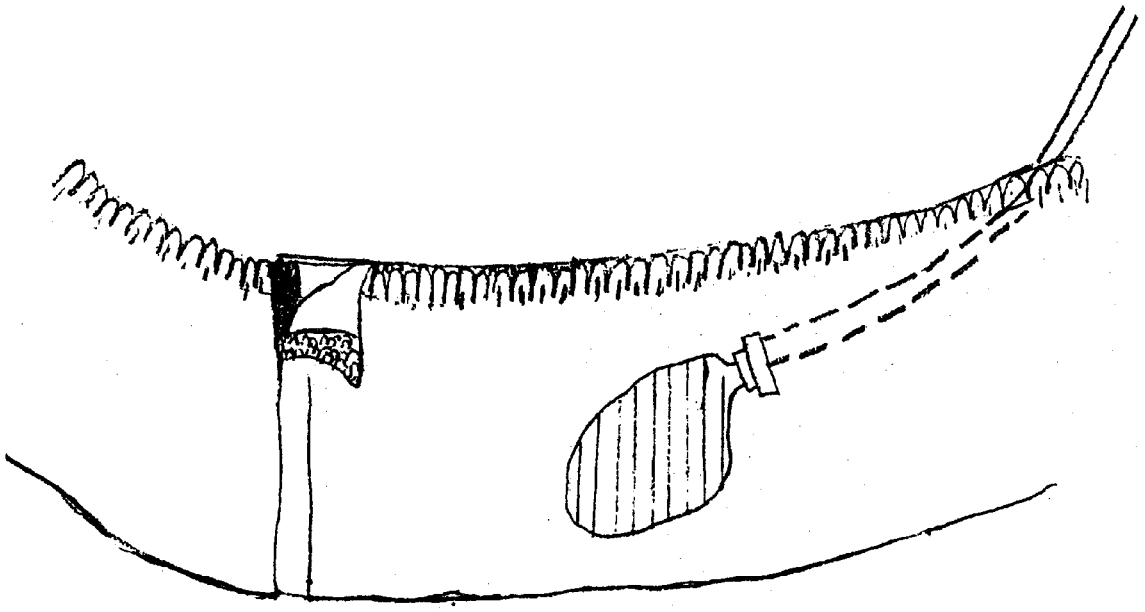
FIG. 6 is a front perspective of the storage pouch showing a front closure according to an alternate embodiment.

As shown in FIGS. 1, 5 and 6, storage pouch 80 provides divided pockets with elastic top entry so that collection bulbs 81 are within easy, convenient reach for emptying lymphatic fluids and other waste materials. Storage pouch 80 comprises first panel 82, second panel 86, bottom edge 85*a*, side edges 85*b* and 85*c* and top edge 85*d*. First panel 82 comprises front surface 83*a*, rear surface 83*b* and top edge 84. Second panel 86 comprises front surface 87*a*, rear surface 87*b* and top edge 88. In accordance with the preferred embodiment, panels 82 and 86 are sewn along seams 89*a*, 89*b*, 89*c*. As is seen in the drawings, the storage pouch 80 is generally rectangular shaped and is constructed by sewing first panel 82 to second panel 86 along bottom edge 85*a* and side edges 85*b* and 85*c*. The top edge 84 of first panel 82 remains a free edge as does the top edge 88 of second panel 86. Collection bulbs 81 are contained within a pocket formed between first panel 82 and second panel 86. Preferably, elastic material is applied to top edge 88 of second panel 86 in order to facilitate insertion and retention of collection bulbs 81.

Top edge 85*d* of storage pouch 80 releasably attaches to the torso band 65 with hook-and-loop fastening system. Hook-and-loop fasteners such as VELCRO is attached to rear surface 83*b* of first panel 82 proximate to top edge 84. Torso band 65 comprises the mating hook-and-loop fastener as described above. Alternatively, storage pouch 80 attaches to torso band 65 with hook and eye fasteners. Preferably, storage pouch 80 only partially encircles the torso to reduce material costs. Alternatively, as shown in FIG. 6, storage pouch 80 extends around the entire torso, with a front closure means 90, preferably with hook-and-loop fastening system such as VELCRO.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A post-surgical prosthetic brassiere for supporting drain tubing and fluid collection bulbs associated with surgical drain assemblies extending from one or more surgical incision sites on the torso of the woman, the brassiere comprising:

a pair of front panels, each of said front panels having a bottom edge, a top edge, a free edge and a cup portion for supporting either one of the woman's breasts or a prosthesis;

rear panels contiguous with said front panels for connecting said front panels together, said rear panels having a bottom edge and a top edge extending under the arms and around the back of the woman;

fastening means disposed adjacent to said free edges of each of said front panels for connecting said free edges wherein the brassiere fastens in the front;

prosthesis pocket behind at least one of said cup portions for containing a prosthesis, said prosthesis pocket comprising a pair of panels, each said panel having a free edge wherein said free edge of said first panel overlaps said free edge of said second panel thereby providing a closure through which the prosthesis is inserted and removed;

at least one deformable aperture in said brassiere, said aperture expands or contracts to contain the surgical drain tubing; and a pouch comprising first and second elongated panels, said first panel fixedly attached to said second panel to form a bottom seam, a first side seam and a second side seam thereby forming at least one pocket for storing a plurality of collection bulbs wherein said pouch is releasably attached to bottom edge of each of said front panels by pouch fastening means whereby said apertures and said pouch in combination with said prosthesis pocket allows the brassiere to be worn acutely following surgical procedure.

2. The brassiere of claim 1 wherein said fastening means disposed adjacent to said free edges of said front panels for connecting said free edges together comprises hook-and-loop fasteners.

3. The brassiere of claim 1 wherein said fastening means disposed adjacent to said free edges of said front panels for connecting said free edges together comprises hook-and-eye fasteners.

4. The brassiere of claim 1 wherein said deformable aperture is expanded or contracted by closures disposed adjacent to said aperture.

5. The brassiere of claim 4 wherein said closures comprises hook-and-loop fasteners.

6. The brassiere of claim 1 wherein said pouch fastening means comprises hook-and-loop fasteners.

7. The brassiere of claim 1 wherein said pouch fastening means comprises hook-and-eye fasteners.

8. A post-surgical prosthetic brassiere for supporting drain tubing and collection bulbs associated with surgical drain assemblies extending from one or more surgical incision sites on the torso of the woman, the brassiere comprising:

a pair of front panels, each of said front panels having a bottom edge, a top edge, a free edge and a cup portion for supporting either one of the woman's breasts or a prosthesis;

rear panel means contiguous with said front panels for connecting the front panels together and for extending under the arms and around the back of the woman, said rear panel means having a bottom edge, a top edge and a free edge;

first fastening means disposed adjacent to said free edges of each of said front panels for connecting said free edges wherein the brassiere opens and fastens in the front;

second fastening means disposed adjacent to said free edge of each of said rear panels for connecting said free edges wherein the brassiere opens and fastens in the rear;

support means behind at least one of the cup portions for containing a prosthesis; and means for accommodating surgical drain assembly whereby said means for accommodating surgical drain system in combination with said support means for the prosthesis allows the brassiere to be worn acutely following surgical procedure and said first and second fastening means allows a physician to freely examine the woman.

9. The brassiere of claim 8 wherein said support means comprises a pair of panels, each said panel having a free edge wherein said free edge of said first panel overlaps said free edge of said second panel thereby providing a closure through which the prosthesis is inserted and removed.

10. The brassiere of claim 8 wherein said means for accommodating surgical drain assembly comprises at least one deformable aperture in the brassiere, said aperture expands and contracts to contain the surgical drain tubing.

11. The brassiere of claim 10 wherein said deformable aperture is expanded and contracted by closures disposed adjacent to said aperture.

12. The brassiere of claim 11 wherein said closures are hook-and-loop fasteners.

13. The brassiere of claim 10 wherein said means for accommodating surgical drain assembly further comprises a pouch comprising first and second elongated panels, said first panel fixedly attached to said second panel to form a bottom seam, a first side seam and a second side seam thereby providing at least one pocket for storing a plurality of collection bulbs, said pouch is releasably attached to bottom edge of each of said front panels by pouch fastening means.

14. The brassiere of claim 8 wherein said fastening means disposed adjacent to said free edges of said front panels for connecting said free edges comprises hook-and-loop fasteners.

15. The brassiere of claim 8 wherein said fastening means disposed adjacent to said free edges of said rear panels for connecting said free edges comprises hook-and-eye fasteners.

16. The brassiere of claim 13 wherein said pouch fastening means comprises hook-and-loop fasteners.

17. The brassiere of claim 13 wherein said pouch fastening means comprises hook-and-eye fasteners.

18. A post-surgical brassiere for supporting drain tubing and collection bulbs associated with surgical drain assemblies extending from one or more surgical incision sites on the torso of the woman, the brassiere comprising:

a pair of front panels, each of said front panels having a bottom edge, a top edge, a free edge and a cup portion for supporting the woman's breasts;

rear panels contiguous with said front panels for connecting said front panels together, said rear panels having a bottom edge and a top edge extending under the arms and around the back of the woman;

first fastening means disposed adjacent to said free edges of each of said front panels for connecting said free edges wherein the brassiere opens and fastens in the front;

second fastening means disposed adjacent to said free edge of each of said rear panels for connecting said free edges wherein the brassiere opens and fastens in the rear;

at least one deformable aperture in said brassiere, said deformable aperture expands or contracts to contain the surgical drain tubing; and a pouch comprising first and second elongated panels, said first panel fixedly attached to said second panel to form a bottom seam, a first side seam and a second side seam thereby forming at least one pocket for storing a plurality of collection bulbs wherein said pouch is releasably attached to bottom edge of each of said front panels whereby said apertures and said pouch in combination allows the brassiere to be worn acutely following surgical procedure.

19. The brassiere of claim 18 wherein said first fastening means comprises hook-and-loop fasteners.

20. The brassiere of claim 13 wherein said second fastening means comprises hook-and-eye fasteners.

* * * * *